US005104330A

United States Patent [19]

Yagi et al.

[11] Patent Number: 5,104,330

[45] Date of Patent: Apr. 14, 1992

[54] ELECTRIC CONNECTOR

[75] Inventors: Sakai Yagi; Satoshi Yamada, both of Shizuoka, Japan

[73] Assignee: Yazaki Corporation, Tokyo, Japan

[21] Appl. No.: 707,555

[22] Filed: May 30, 1991

[30] Foreign Application Priority Data

May 30, 1990 [JP] Japan ..... 2-138271

[51] Int. Cl.[5] ..... H01R 13/62

[52] U.S. Cl. ..... 439/157; 439/353

[58] Field of Search ..... 439/152-160, 439/341, 372, 326-328, 352-358; 361/413-415

[56] References Cited

U.S. PATENT DOCUMENTS

| | | | |
|---|---|---|---|
| 2,987,693 | 6/1961 | Wamsley | 439/157 |
| 3,944,311 | 3/1976 | Sprenkle et al. | 439/157 |
| 4,582,378 | 4/1986 | Fruchard | 439/157 |
| 4,740,164 | 4/1988 | Schulg et al. | 439/157 |
| 4,941,839 | 7/1990 | Nagasaka et al. . | |
| 5,032,087 | 7/1991 | Koiner et al. | 439/341 |

FOREIGN PATENT DOCUMENTS 62-178469 11/1987 Japan .

*Primary Examiner*—David L. Pirlot

*Attorney, Agent, or Firm*—Sughrue, Mion, Zinn, Macpeak & Seas

[57] ABSTRACT

An electric connector comprises a male connector a female connector having a hood for receiving the male connector; and detachavle device, for engaging/disengaging the female connector to male connector, including a lever member having a pair of lever arms pivotally mounted at their one ends on opposite side surfaces of the hood, and a connecting bar interconnecting the other ends of the two lever arms; first lock device mounted on the connecting bar for engaging with the hood to lock the lever member; second lock device, mounted on the an outer peripheral surface of a housing of the male connector, for engaging with the hood to lock the male connector; receptive portion, provided on the outer peripheral surface of a housing of the male connector, for engaging respectively with the lever arms intermediate the opposite ends of the lever arms; and lock release device, mounted on the outer peripheral surface of a housing of the male connector, for engaging with the first lock device.

6 Claims, 6 Drawing Sheets

ELECTRIC CONNECTOR

BACKGROUND OF THE INVENTION

This invention relates to an improved electric connector in which the fitting of a female connector into a male connector can be effected with a low insertion force, utilizing an operating lever.

There has been proposed a conventional electric connector of this type having such a construction as shown in FIGS. 7 and 8(*a*) to 8(*c*) (Japanese Laid-Open Utility Model Application No. 178469/87).

In this connector, there is provided an operating lever 2 having pivotal points O (pivot pins 1*b*) on opposite side surfaces 1*a* of a female (connector) housing 1, and a male housing 3 has at its opposite side surfaces receptive portions 4 with which end operating portions 2*a* of the operating lever 2 are engageable, respectively. Lock means 5 or 6 for the operating lever 2 is provided on at least one of the housings 1 and 3.

After the initial engagement (fitting) between the two housings 1 and 3, the operating portions 2*a* of the operating lever 2 are engaged respectively in the receptive portions 4 as shown in FIG. 8(*b*), and the lever 2 is pushed to be pivotally moved in a direction of arrow P so as to advance the male housing 3 toward the female housing 1 (FIG. 8(*c*)), and the fitting is completed when the lever 2 is lockingly engaged with the lock pawls 5 and 6 (FIG. 8(*d*)). Since a large force can be obtained by the leverage of the operating lever 2, the fitting of the multi-pole electric connector can be carried out with a small force.

In the conventional electric connector, before the two housings 1 and 3 are used or fitted relative to each other, the operating lever 2 can be provisionally locked by the lock pawls 5 as shown in phantom in FIG. 8(*a*); however, since the operating lever 2 is projected forwardly from the housing, it is possible that this lever may get caught in wires, and may be damaged by an external force.

For using the connector, the lock is released, and the operating lever is moved into an upstanding condition as shown in FIG. 8(*a*); however, in this condition, this lever may get caught in wires as in the above case, and in addition since there is no retaining means, it is possible that the operating lever may fall as indicated by arrow Q. Therefore, the operating lever must be held by the hand until the initial fitting (FIG. 8(*b*)) is finished. Thus, the operation is cumbersome.

SUMMARY OF THE INVENTION

The present invention has been made in view of the above problems, and an object of the invention is to provide an electric connector in which an operating lever will not be projected from a housing, and therefore will not get caught in wires and will not be damaged, and at the time of the fitting operation, it is not necessary to release the locking of the operating lever and to support the lever, which are cumbersome operations, and the fitting can be carried out easily with a small force.

The above object has been achieved by an electric connector comprising a male connector, a female connector having a hood for receiving said male connector, and a lever member for fitting and releasing purposes which is pivotally and lockably mounted on said hood;

said lever member having two lever arms pivotally mounted at their one ends on opposite side surfaces of said hood, and a connecting bar interconnecting the other ends of said two lever arms, there being provided a lock spring mounted on said connecting bar so as to engage with said hood to lock said lever member;

receptive portions for engaging respectively with said lever arms intermediate the opposite ends of said lever arms, as well as a lock release projection, being provided on an outer peripheral surface of a housing of said male connector;

said lock release projection urging said lock spring upon an initial fitting of said male connector into said hood, thereby releasing the locking of said lever member, so that said lever arms are pivotally moved toward the front side of said hood to be engaged in said receptive portions, respectively;

said male connector being advanced toward said female connector by the pivotal movement of said lever member to complete the fitting connection between said two connectors whereupon said lever member is again locked relative to said hood by said lock spring.

In the electric connector of the present invention, the fitting connection between the male and female connectors as well as the release thereof can be carried out by the pivotal movement of the lever member with a relatively small force.

Before the female and male connectors are fitted together or when they are not used, the lever member is locked by the lock spring along the hood of the female connector, and therefore there are no possibilities that the lever member will get caught in wires and that the lever member will be damaged by contact with other devices.

The locking of the lever member is released by the initial fitting connection between the female and male connectors, and after the fitting is completed, the lever member is again locked. On the other hand, by providing the spring between the lever arm and the hood, the lever arm is automatically engaged with the receptive portion of the male connector by the resilient force of this spring. Therefore, the fitting and releasing operations can be carried out easily.

DETAILED DESCRIPTION OF THE PREFERRED EMBODIMENTS

The above construction and operation will be specifically described below with reference to the drawings illustrating a preferred embodiment of the invention.

Figure 1:
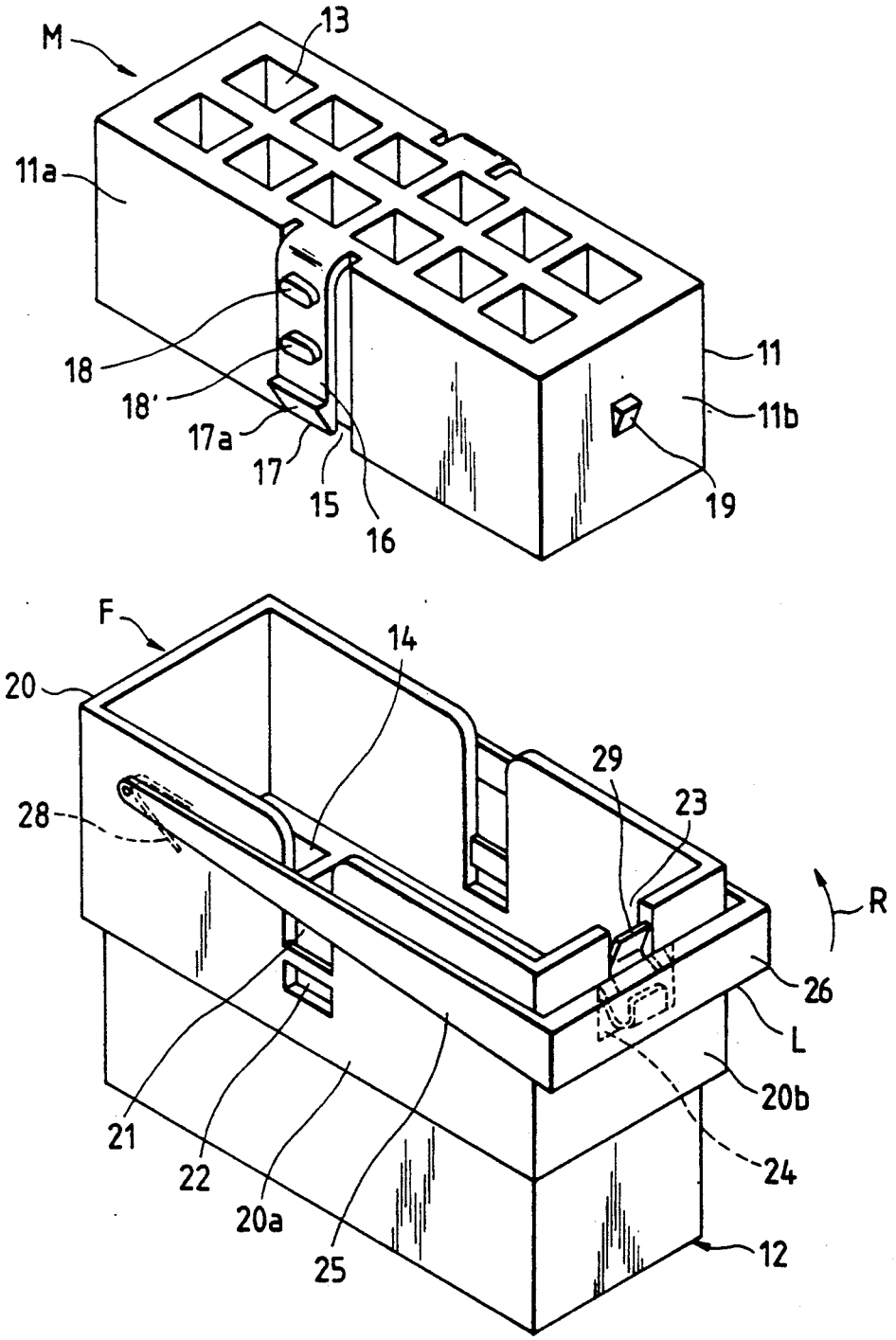
FIG. 1 is a perspective view of one preferred embodiment of an electric connector of the present invention, showing female and male connectors as being separate from each other.
Figure 2:
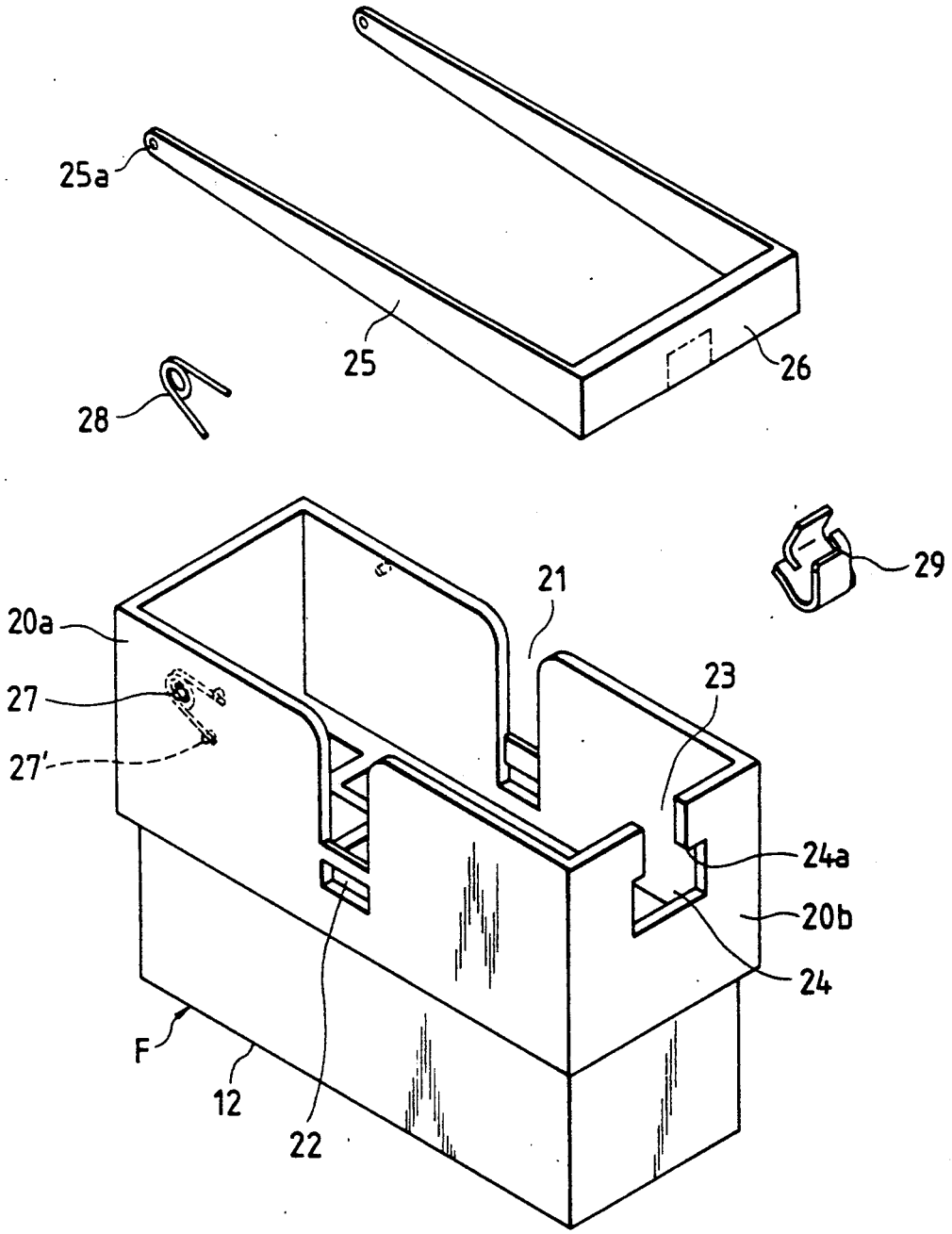
FIG. 2 is an exploded perspective view of the female connector.
Figure 3:
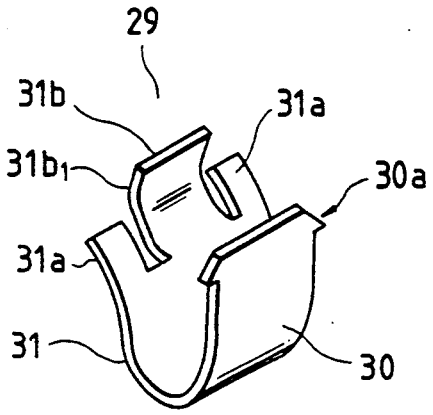
FIG. 3 is an enlarged perspective view of a lock spring for a lever member.
Figure 4:
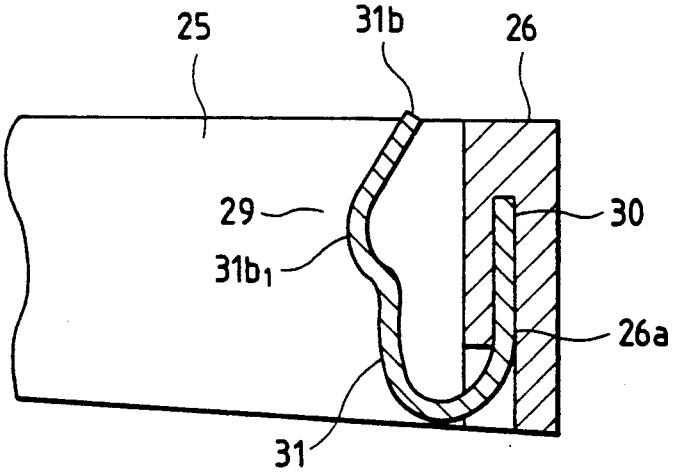
FIG. 4 is a cross-sectional view of an important portion showing the mounted condition of the lock spring.

FIG. 1 is a perspective view of an electric connector of the present invention in its separated condition. FIG. 2 is an exploded perspective view of a female connector. FIG. 3 is an enlarged perspective view of a lock spring for a lever member. FIG. 4 is a cross-sectional view of an important portion showing the mounted condition of the lock spring.

In these Figures, the electric connector comprises a male connector M, and the female connector F having the lever member L for fitting and releasing purposes. The two connectors M and F include a male housing 11 and a female housing 12, respectively, both of which are made of an insulative synthetic resin. Each of the two housings has a plurality of terminal receiving chambers 13 (14) into which female (male) terminals (not shown) of the known type are inserted.

The male housing 11 has a vertical groove 15 formed in a central portion of each of its opposite longitudinal side walls 11*a*, and a flexible lock arm 16 is provided at the groove 15. Each lock arm 16 extends in the direction of fitting, and has a lock pawl 17 at its distal end, and has a pair of lock projections 18 and 18' for engagement with an arm 25 of the lever member L which lock projections are provided intermediate the opposite ends of the lock arm 16. A projection 19 for releasing the locking of the lever member L is formed on one end wall 11*b* of the male housing 11.

The female housing 12 has a hood 20 for receiving the male housing 11. Formed respectively in opposite longitudinal side walls 20*a* of the hood 20 are notches 21 into and out of which the lock projections 18 and 18' of the lock arms 16 are movable, respectively. Formed below each of the notch 21 is a lock hole 22 in which the lock pawl 17 is engageable. One end wall 20*b* of the hood 20 has a narrow notch 23 into and out of which the projection 19 is movable, and the one end wall 20*b* also has a lock spring engagement opening 24 continuous with the notch 23. A lock spring 29 (later described) of the lever member L is received and retained in the lock spring engagement opening 24.

The lever member L has two lever arms 25 and a connecting bar 26 interconnecting one ends of the two lever arms, so that the lever member has a gate-shape. Each lever arm 25 has a pivot hole 25*a* at the other end thereof, and is pivotally supported by a pin 27 (pivot point) formed on the hood side wall 20*a*. One end of a spring 28 wound around the pin 27 is engaged with a stop pin 27' on the hood side wall 20*a*, and the other end thereof is engaged with the arm 25 to normally urge the arm 25 upwardly as indicated by arrow R.

As shown in FIGS. 3 and 4, the lock spring 29 is mounted on the inner side of the connecting bar 26.

The lock spring 29 comprises a resilient metal plate, has a press-fitting plate portion 30 and a resilient lock plate 31, the lock spring 29 being bent into a generally U-shaped cross-section. The press-fitting plate portion 30 has press-fitting fixing pawls 30*a* at its opposite sides at its distal end, and is press-fitted in and fixed to a groove 26 formed in the connecting bar 26. The resilient lock plate 31 has lock pieces 31*a* and 31*a* at its upper half portion at its opposite sides, and a lock release piece 31*b* at its central portion. The distal end portion of each lock piece 31*a* is bent away from the press-fitting plate portion 30, and the lock release piece 31*b* is projected beyond the lock pieces 31*a*, and has a curved portion $31b_1$ at its central portion.

Next, the manner of using the female and male connectors F and M as well as the operation will now be described.

Figure 5A:
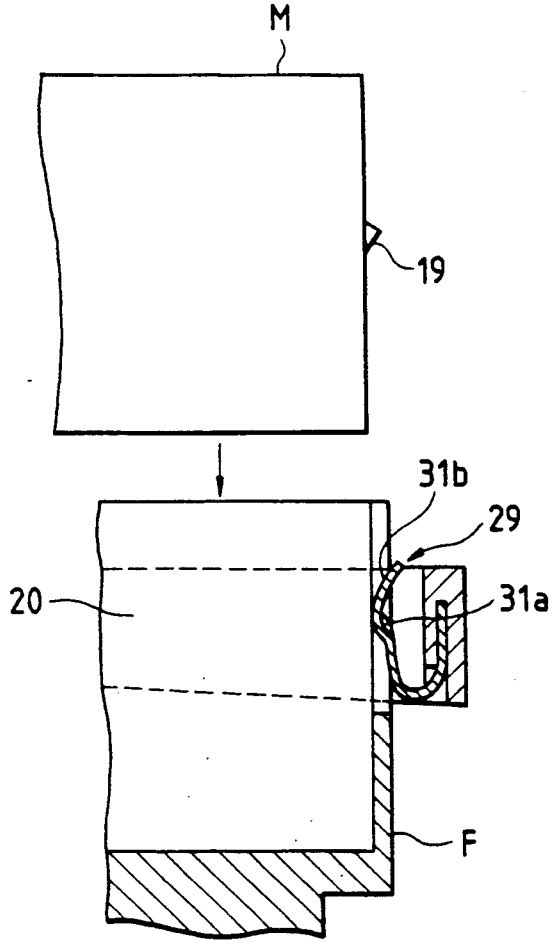
FIGS. 5(*a*) to 5(*c*) are cross-sectional views of important portions showing the operation of the lock spring.
Figure 5B:
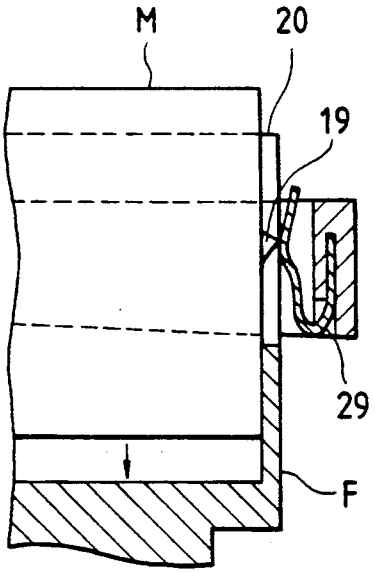
Figure 5C:
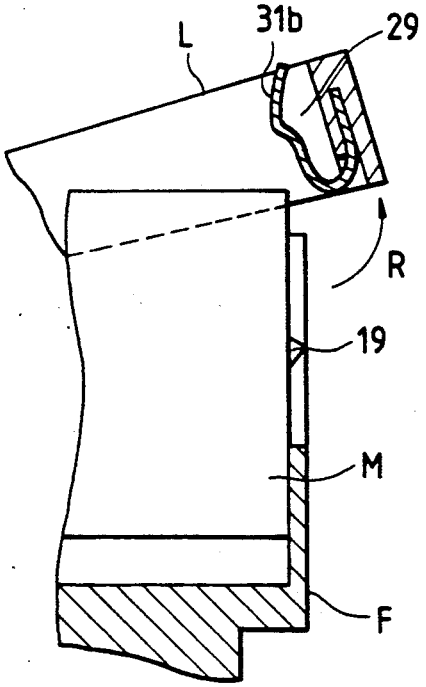

Before the two connectors are used or fitted relative to each other, the lever member L of the female connector F is depressed against the bias of the spring 28 (see FIG. 1) in a direction opposite to the direction of arrow R, and the lock pieces 31*a* of the lock spring 29 on the connecting bar 26 are engaged with an upper edge 24*a* of the lock spring engagement opening 24, so that the lever member L is locked (FIG. 5(*a*)).

In this condition, as shown in FIG. 5(*b*), when the male connector M is fitted in the hood 20 of the female connector F, the lock release projection 19 received in the notch 23 is brought into sliding contact with the lock release piece 31*b* of the lock spring 29 to urge the same outwardly. As a result, the locking between the lock pieces 31*a* and the upper edge 24*a* is released, so that the lever member L is instantly pivotally moved in the direction of arrow R by the resilient force of the spring 28 (FIG. 5(*c*)).

Each lever arm 25, pivotally moved in the direction of arrow R as a result of this lock release, is guided by a tapered surface of the lock pawl 17 moving along the notch 21 of the hood 20, so that the lever arm 25 is fitted in a recess between the pair of lock projections 18 and 18'. As a result, the male connector M and the lever member L are engaged with each other.

Figure 6:
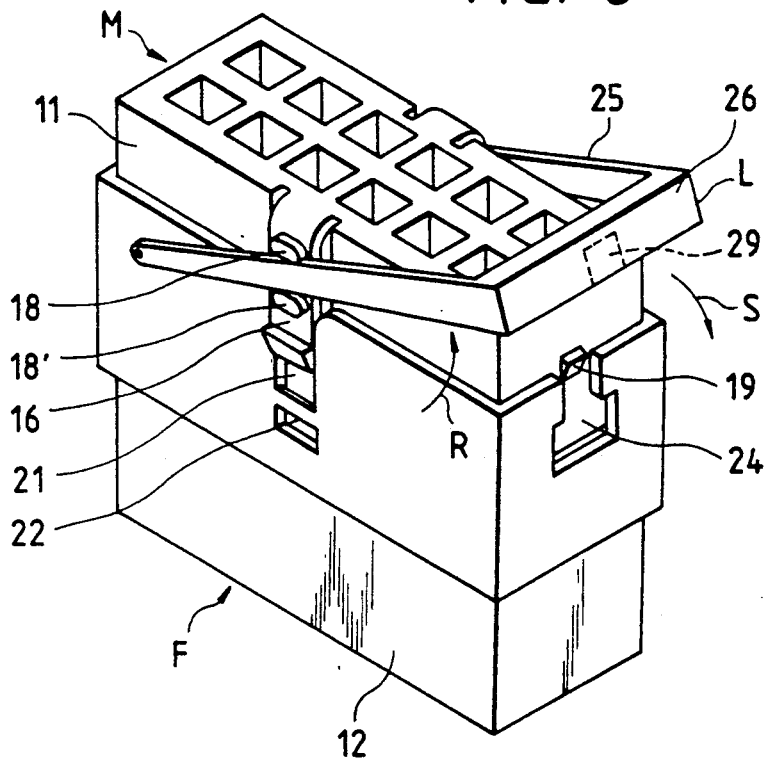
FIG. 6 is a perspective view showing the initial fitting connection between the female and male connectors.
Figure 7:
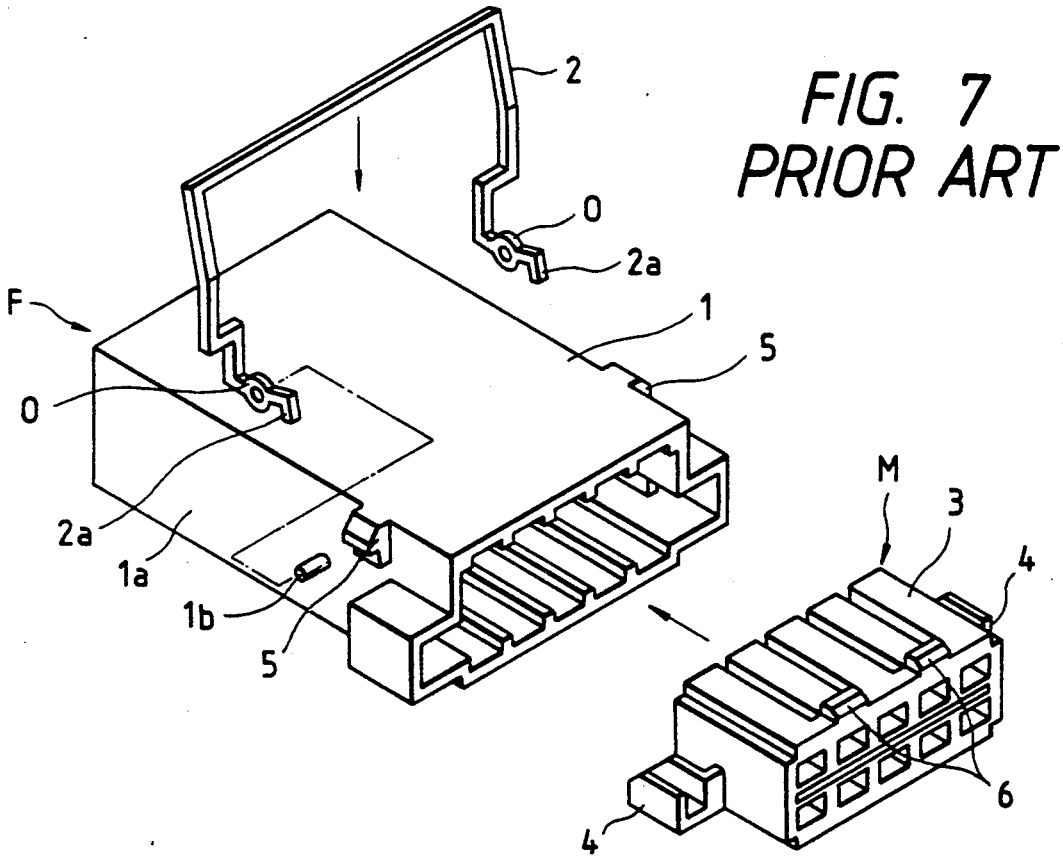
FIG. 7 PRIOR ART
FIG. 7 is an exploded perspective view of a conventional electric connector.
Figure 8A:
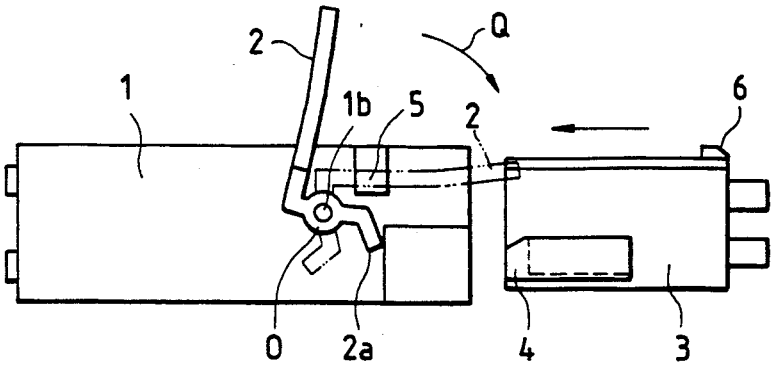
FIG. 8(a) PRIOR ART
FIGS. 8(*a*) to 8(*d*) are side-elevational views showing the operation of the conventional electric connector.
Figure 8B:
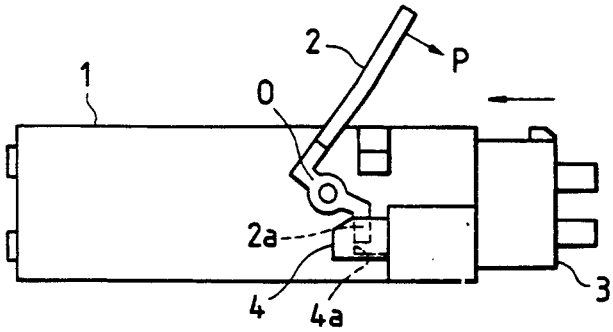
FIG. 8(b) PRIOR ART
Figure 8C:
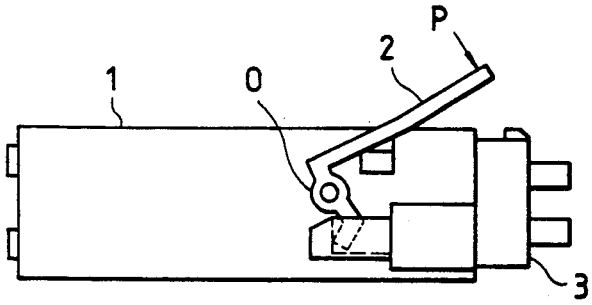
FIG. 8(c) PRIOR ART
Figure 8D:
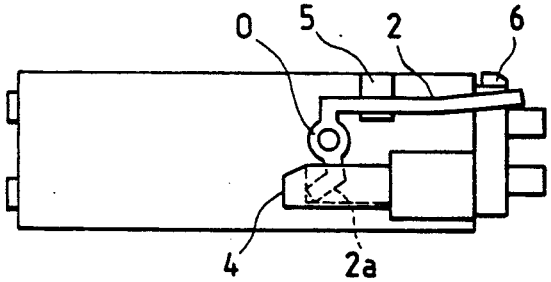
FIG. 8(d) PRIOR ART

This engagement condition is shown in FIG. 6. More specifically, one (18) of the pair of lock projections 18 and 18' serves as a stopper for the lever arm 25, and the other (18') serves as a receiving portion for the operating portion of the arm 25.

In this condition, when the operating lever L is depressed about the pivot points 27 in the direction of arrow S, the male connector M is fitted in the female connector F with a relatively small force due to the leverage action in which the connecting bar 26 serves as the force applying portion for the lever arm 25 and the lock projection 18' serves as the operating portion. As a result, the above- mentioned female and male terminals are electrically connected together.

When the female and male connectors F and M are fitted together by the operation of the lever member L, the lock pawl 17 of each lock arm 16 is engaged in the lock hole 22, so that the two connectors are locked together. At the same time, the lock pieces 31*a* of the lock spring 29 on the lever member L are again engaged with the upper edge 24*a* of the lock spring engagement opening 24, so that the condition shown in FIG. 5(*a*) is recovered.

For releasing the female and male connectors F and M from each other, the locking of the lever member L by the lock spring 29 is released, and the lever member L is operated in the direction opposite to the above direction. This can also be carried out with a small force. In this case, the other lock projection 18 serves as the receiving portion for the operating portion of the lever arm 25.

In the above embodiment, although the engagement portions (lock projections 18 and 18') of the male connector M for the lever member L are formed integrally with the lock arm 16, they may be separate from each other. Incidentally, in the case where the lock projections 18 and 18' are separate from the lock arm 16, the one lock projection 18' has a tapered surface as is the case with the lock pawl 17.

As described above, in the electric connector of the present invention, the fitting connection between the female and male connectors as well as the releasing thereof is carried out utilizing the leverage action caused by the pivotal movement of the lever member. Therefore, these can be carried out with a relatively small force.

Before the female and male connectors are fitted relative to each other, or when they are not used, and after this fitting is completed, the lever member is locked by the lock spring in such a manner as to extend along the hood. Therefore, there are no possibilities that the lever member will get caught in wires and that the lever member will be damaged by contact with other devices.

Further, the locking of the lever member is released by the initial fitting connection between the female and male connectors, and is pivotally moved toward the male connector by the resilient force of the spring to be automatically engaged with its receptive portion. Therefore, it is not necessary to support the lever member by the hand at the time of the fitting operation, which is cumbersome, and therefore the efficiency of the operation is improved.

What is claimed is:

1. An electric connector comprising:

a male connector;

a female connector having a hood for receiving said male connector; and detachable means, for engaging/disengaging said female connector to said male connector, including:

a lever member having a pair of lever arms pivotally mounted at respective first ends on opposite side surfaces of said hood, and a connecting bar interconnecting the other ends of said two lever arms;

first lock means mounted on said connecting bar for engaging with said hood to lock said lever member;

second lock means, mounted on said outer peripheral surface of a housing of said male connector, for engaging with said hood to lock said mail connector;

a receptive portion, provided on said outer peripheral surface of the housing of said male connector, for engaging respectively with said lever arm intermediate the opposite ends of said lever arms; and lock release means, mounted on said outer peripheral surface of the housing of said male connector, for engaging with said first lock means.

2. An electric connector as claimed in claim 1, wherein said second lock means is a pair of lock arms, which extends in a direction of mating, formed approximately in a central portion of opposite longitudinal side walls of said male connector, respectively.

3. An electric connector as claimed in claim 1, wherein said first lock means is a lock spring having a resilient metal plate which is bent into a generally U-shaped cross-section and has a press-fitting plate portion and a resilient lock plate, said press-fitting plate portion being press-fitted in and fixed to a groove in said connecting bar, and said resilient lock plate having lock pieces at its upper half portion at its opposite side portions, and a lock release piece at its central portion which is engageable with said lock release projection of said male connector.

4. An electric connector as claimed in claim 1, further comprising:

spring means, for urging said lever member toward a front side of said hood, provided between said lever arm of said lever member and said hood of said female connector.

5. An electric connector as claimed in claim 1, wherein said receptive portion is a pair of lock projections for engaging with said arm of said lever member.

6. An electric connector as claimed in claim 5, wherein said lock projections are integrally formed with said rock arms.

* * * * *